US007609285B2

(12) United States Patent
Miyazawa

(10) Patent No.: US 7,609,285 B2
(45) Date of Patent: Oct. 27, 2009

(54) EXPOSURE DEVICE AND IMAGE FORMING APPARATUS

(75) Inventor: Takao Miyazawa, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 240 days.

(21) Appl. No.: 11/849,514

(22) Filed: Sep. 4, 2007

(65) Prior Publication Data

US 2008/0080898 A1 Apr. 3, 2008

(30) Foreign Application Priority Data

Sep. 29, 2006 (JP) ..... 2006-267583

(51) Int. Cl.
*B41J 2/45* (2006.01)

(52) U.S. Cl. ..... 347/238

(58) Field of Classification Search ..... 347/133, 347/238, 241–244, 256–258
See application file for complete search history.

(56) References Cited

U.S. PATENT DOCUMENTS 4,435,064 A * 3/1984 Tsukada et al. ..... 355/1
5,835,119 A * 11/1998 Samuels ..... 347/238
6,989,849 B2 * 1/2006 Nomura et al. ..... 347/133
7,248,277 B2 * 7/2007 Ishikawa ..... 347/238
7,432,945 B2 * 10/2008 Kobayashi ..... 347/238

FOREIGN PATENT DOCUMENTS

JP A 2000-158705 6/2000
JP A 2001-205845 7/2001

* cited by examiner

*Primary Examiner*—Hai C Pham
(74) *Attorney, Agent, or Firm*—Oliff & Berridge, PLC

(57) ABSTRACT

An exposure device includes a first light source column, a second light source column, and a light converger. A distance along a first direction between the center of a first light source of the first light source column and the center of a second light source of the second light source column, which is located to a second direction relative to the first light source, is larger than a distance along the first direction between the center of a third light source of the first light source column, which is located farther from an optical axis of the light converger than the first light source and the center of a fourth light source of the second light source column, which is located to the second direction relative to the third light source.

9 Claims, 9 Drawing Sheets

EXPOSURE DEVICE AND IMAGE FORMING APPARATUS

BACKGROUND

1. Technical Field

The present invention relates to an exposure device that is provided with a plurality of light sources and also to an image forming apparatus that uses the exposure device.

2. Related Art

In an existing art, it has been proposed that an electrophotographic image forming apparatus that uses an exposure device, in which a plurality of light emitting elements are arranged, for exposing an image carrier such as a photoreceptor drum. A configuration in which microlenses are arranged to be opposed to groups (hereinafter, referred to as "element groups") into which a plurality of light emitting elements are separated in units of the predetermined number of elements, which is described in JP-A-2000-15875 and JP-A-2001-205845. Light emitted from the predetermined number of light emitting elements that belong to one of the element groups is collected by the microlens corresponding to the element group to form an image on the surface of the image carrier.

Meanwhile, a positional relationship (for example, a distance) between each of the light emitting elements that belong to one of the element groups and the optical axis of the corresponding microlens varies every light emitting element in the group. For this reason, the size of a region that light emitted from each light emitting element reaches on the surface of the image carrier (hereinafter, referred to as "spot region") and/or the intensity of energy applied to the spot region vary every light emitting element due to various conditions such as an aberration of microlens. Thus, there is a problem that an image formed with the image forming apparatus may have non-uniformity in resolution and/or gray-scale level.

SUMMARY

An advantage of some aspects of the invention is that it suppresses variation in sizes of spot regions and/or variation in intensities of energy applied to the spot regions.

An aspect of the invention provides an exposure device. The exposure device includes a first light source collumn, a second light source column, and a light converger. The first light source column includes a plurality of light sources that are arranged in a first direction (for example, in an X direction shown in FIG. 7) The second light source column includes a plurality of light sources that are arranged in the first direction and located a distance from the corresponding light sources of the first light source column in a second direction (for example, in a Y direction shown in FIG. 7) that intersects with the first direction. The light converger (for example, a lens 44 shown in FIG. 4) collects light emitted from each of the light sources of the first light source column and the second light source column toward an exposed surface. Light emitted from the light sources of the first light source column and light emitted from the corresponding light sources of the second light source column, which are located to the second direction relative to the light sources of the first light source column, are multiply exposed on the exposed surface. A distance (for example, a distance S1 shovel in FIG. 7) along the first direction between the center of a first light source (for example, a light emitting element E1 shown in FIG. 7) of the first light source column and the center of a second light source (for example, a light emitting element E2 shown in FIG. 7) of the second light source column, which is located to the second direction relative to the first light source, is larger than a distance (for example, a distance S2 shown in FIG. 7) along the first direction between the center of a third light source (for example, a light emitting element E3 shown in FIG. 7) of the first light source column, which is located farther from an optical axis of the light converger than the first light source and the center of a fourth light source (for example, a light emitting element E4 shown in FIG. 7) of the second light source column, which is located to the second direction relative to the third light source. From another point of view, the positions of the light sources in each of the first light source column and the second light source column are selected so that a distance along the first direction between the center of one of the light sources of the first light source column and the center of the corresponding one of the adjacent light sources of the second light source column in the second direction relative to the one of the light sources of the first light source column increases the farther the light source of the first light source column is located from the optical axis of the light converger. Note that the light source may preferably employ a light emitting element such as an organic light emitting diode element, for example.

In the above described configuration, the distance between the center of the first light source and the center of the second light source is larger than the distance between the center of the third light source and the center of the fourth light source, wherein the third light source and the fourth light source are located farther from the optical axis of the light converger than the first light source and the second light source. Thus, even when the sizes of the spot regions tend to be increased the farther the light source is located from the optical axis of the light converger (for example, an aberration of the light converger), in comparison with a configuration in which the adjacent light sources located to the second direction are located at the same positions along the first direction, it is possible to reduce a difference in size between a spot region formed by multiply exposing light with the first light source and the second light source and a soot region formed by multiply exposing light with the third light source and the fourth light source.

Further in the aspect of the invention, the light source of the first light source column, which is located the farthest from the optical axis of the light converger (for example, a light emitting element E7 shown in FIG. 7) and the light source of the second light source column, which is located to the second direction relative to the corresponding light source of the first light source column (for example, a light emitting element E8 shown in FIG. 7), may be located at the same position along the first direction. According to the present aspect, light emitted from the light sources of the first light source column, which are located the farthest from the optical axis, and light emitted from the light sources of the second light source column, which are located adjacent to the light sources of the first light source in the second direction, sufficiently overlap each other on the exposed surface. Thus, in comparison with a configuration in which the positions of these light sources in the first direction are different from each other, it is possible to highly efficiently apply energy to a spot region by multiply exposing light with both of the light sources.

In the aspect of the invention, the sizes of the third light source and the fourth light source may be larger than the sizes of the first light source and the second light source. For example, the size of the light source is larger the farther the light source is located from the optical axis of the light converger. According to the above aspect, even when the intensity of energy tends to decrease the farther the light source that forms a spot region is located from the optical axis of the light converger, in comparison with a configuration in which the light sources have the same size, it is possible to reduce a difference between the intensity of energy applied to a spot region by multiply exposing light with the first light source and the second light source and the intensity of energy applied to a spot region by multiply exposing light with the third light source and the fourth light source. Furthermore, in the aspect of the invention, the first light source column may be formed at a position located a predetermined distance away from the optical axis of the light converger, and the second light source column may be formed at a position located a predetermined distance away from the optical axis and on the opposite side relative to the first light source column with the optical axis located therebetween. According to the above aspect, the light sources of the first light source column and the corresponding light sources adjacent to the light sources in the second direction are located the same distance from the optical axis of the light converger, so that it is possible to obtain a desired advantageous effect that the intensity of energy applied to each of the spot regions is uniformized with both of the corresponding light sources having the same size.

Note that a configuration for controlling the position and form of the light source may be arbitrarily determined For example, in an aspect (for example, a first embodiment, which will be described later) in which each of the light sources includes a light emitting element having a light emitting layer positioned inside a port formed in an insulation layer the position and form of each light source may be determined by means of the position and form of the port of the insulation layer, which corresponds to that light source. In addition, in an aspect (for example, a second embodiment, which will be described later) in which each of the light sources includes a light emitting element and a light blocking layer in which a port that allows light, which is emitted from the light emitting element toward the exposed surface, to pass therethrough, the position and form of each light source may be determined by means of the position and form of the port of the light blocking layer, which port corresponds to that light source. In any one of the above aspects, it is possible to control the position and form of each light source with a simple method in high accuracy Note that the form of a light source means the shape and size of a light source.

In the aspect of the invention the position and form of each light source may be selected so that a spot region formed on the exposed surface by multiply exposing light emitted from the first light source and light emitted from the second light source has the same size and the same intensity of energy applied as a spot region formed on the exposed surface by multiply exposing light emitted from the third light source and light emitted from the fourth light source. According to the above aspect, variation in sizes and intensities of energy applied of the spot regions are effectively suppressed. Note that the term "the sizes and Intensities of energy applied of the spot regions are the same" not only includes the case where the sizes and intensities of energy applied completely agree among the spot regions but also includes the case where the sizes and intensities of energy applied are substantially the same among the spot regions.

The exposure device according to the above described aspects may be used in various electronic apparatuses. For example, an image forming apparatus according to any one of the aspects of the invention may include the exposure device according to any one of the aspects, an image carrier, and a developing device. The image carrier for example, a photoreceptor drum) has an exposed surface, on which a latent image is formed by exposing light thereto by means of the exposure device, wherein the exposed surface advances in the second direction relative to the exposure device. The developing device forms a developed image by adding a developer (for example, a toner) to the latent image formed on the image carrier. With the exposure device according to the above aspects, because the sizes and shapes of the spot regions formed on the exposed surface are uniformized, the image forming apparatus that uses the exposure device is capable of forming a high-quality image in which non-uniformity of resolution and gray-scale level is effectively suppressed.

However, applications of the exposure device according to the aspects of the invention are not limited to exposure of an image carrier. For example, in an image reading apparatus, such as a scanner, it is possible to use the exposure device according to the aspects of the invention as a lighting unit for illuminating an original document. The image reading apparatus includes the exposure device according to the above aspects and a light receiving device for example, a light receiving element, such as a CCD (charge coupled device) element) that converts light, which is emitted from the exposure device and then reflected on a reading target (original document), to an electrical signal.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: First Embodiment

Figure 1:
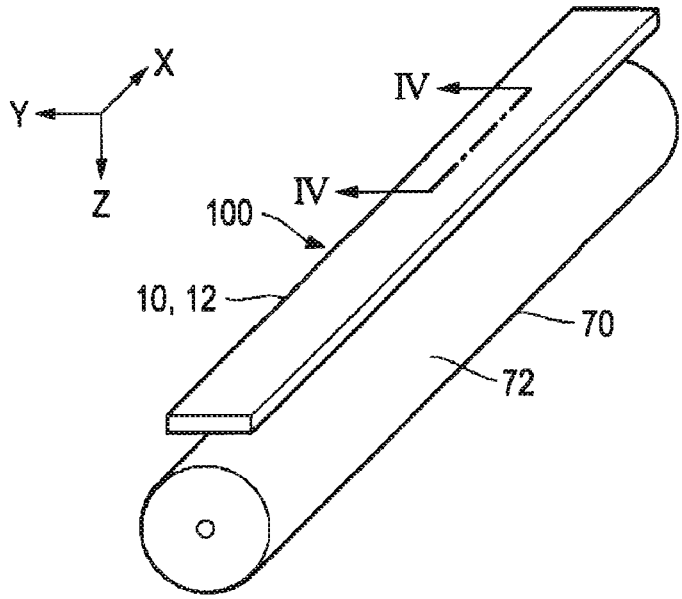
FIG. 1 is a perspective view of a portion of configuration of an image forming apparatus according to a first embodiment of the invention.

FIG. 1 is a perspective view of a portion of configuration of an image forming apparatus according to a first embodiment of the invention. As shown in the drawing, the image forming apparatus includes a photoreceptor drum 70 and an exposure device 100 (line head). The photoreceptor drum 70 has an outer peripheral surface that serves as an exposed surface (image forming surface) 72. The exposure device 100 forms a latent image on the exposed surface 72 by exposing light using the photoreceptor drum 70. The photoreceptor drum 70 is supported by a rotary shaft that extends in an X direction (main scanning direction), and is rotated while the exposed surface 72 is opposed to the exposure device 100. Thus, the exposed surface 72 advances in a Y direction (a direction perpendicular to the X direction) relative to the exposure device 100.

Figure 2:
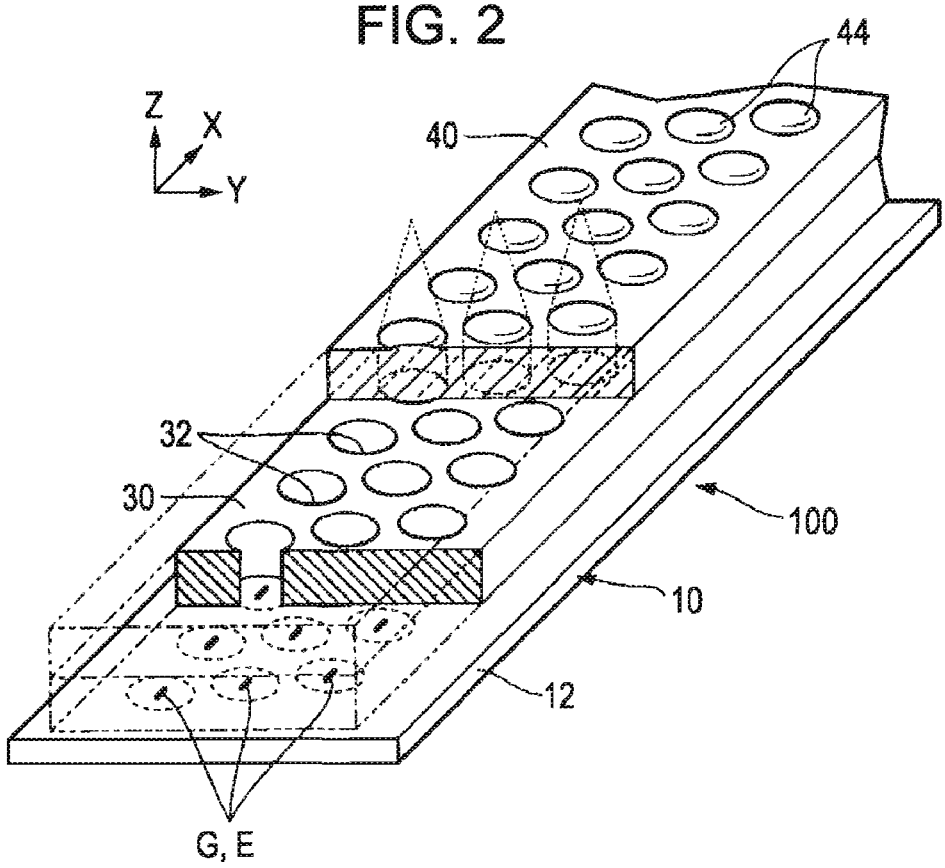
FIG. 2 is a perspective view of a configuration of an exposure device.

FIG. 2 is a perspective view of a configuration of the exposure device 100. FIG. 2 shows the exposure device 100 which is turned over (the positional relationship is changed in a Z direction) from the attitude of the exposure device 100 shown in FIG. 1. As shown in FIG. 2, the exposure device 100 includes a light emitting device 101 a light blocking member 30 and a lens array 40. The light emitting device 10 includes a rectangular substrate 12 that is fixed so that the longitudinal direction of the substrate 12 agrees with the X direction and a plurality of light emitting elements E that are formed on a surface of the substrate 12, which is opposite from the photoreceptor drum 73. The substrate 12 is an optically transparent plate-like material and Is formed of glass, plastic, or the like. The light blocking member 30 is disposed on a surface of the substrate 12 opposite the photoreceptor drum 70, and the lens array 40 is disposed in a clearance between the light blocking member 30 and the photoreceptor drum 70. Each of the light emitting elements E is an organic light emitting diode element that emits light through the supply of electric current and serves as a light source that generates light for exposing light to the exposed surface 72.

Figure 3:
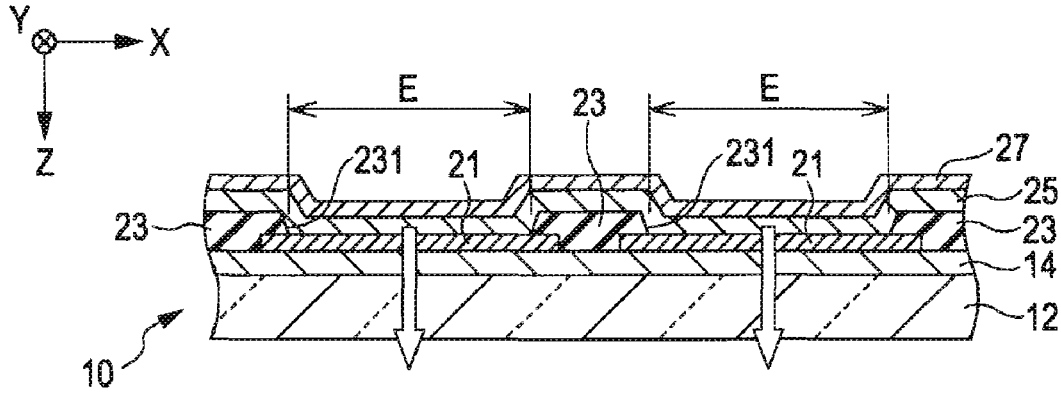
FIG. 3 is a cross-sectional view of a configuration of a light emitting device.

FIG. 3 is a cross-sectional view of a specific configuration of the light emitting device 10. As shown in the drawing, a wiring element layer 14 is formed on the surface of the substrate 12, which is opposite from the photoreceptor drum 70. The wiring element layer 14 is a portion that is formed by laminating conductive layers, such as active elements transistors) that control the amount of light emitted from the light emitting elements E and wirings that transmit various signals, and insulation layers that electrically insulate respective elements. First electrodes 21 are formed on the surface of the wiring element layer 14 corresponding to the light emitting elements E at intervals from each other and serve as anodes of the light emitting elements E. Each of the first electrodes 21 is formed of optically transparent electrically conductive material, such as ITO (indium tin oxide).

An insulation layer 23 is formed on the surface of the substrate 12 on which the first electrodes 21 have been formed. The insulation layer 23 is an electrically insulative film which includes ports 231 (holes that extend through the insulation layer 23 in the thickness direction) formed in a region that overlaps the first electrodes 21 as viewed in the Z direction perpendicular to the surface of the substrate 12. The first electrodes 21 and the insulation layer 23 are covered with a light emitting layer 25 made of organic EL (electroluminescence) material. The light emitting layer 25 is continuously formed over the plurality of light emitting elements E by means of film deposition technique such as a spin coat method, for example. The first electrode 21 is formed in correspondence with each light emitting element E. Therefore, even when the light emitting layer 25 is continuously formed over the plurality of light emitting elements E, the amount of light emitted from each of the light emitting elements E is separately controlled in response to an electric current supplied from each of the first electrodes 2L. Note that the light emitting layer 25 may be separately formed in correspondence with each light emitting element E so that the separately formed light emitting layers are located at intervals from each other.

The surface of the light emitting layer 25 is covered with a second electrode 27 which serves as a cathode of the light emitting elements E. The second electrode 27 is an optically reflective conductive film and is continuously formed over the plurality of light emitting elements E. The light emitting layer 25 emits light with an intensity corresponding to an electric current that flows from the first electrode 21 to the second electrode 27. Light emitted from the light emitting layer 25 toward the first electrodes 21 and light reflected on the surface of the second electrode 27 are transmitted through the first electrodes 21 and the substrate 12 and then exits toward the photoreceptor drum 70, as indicated by outline arrows in FIG. 3. Since electric current does not flow through a region in which the insulation layer 23 is interposed between the first electrodes 21 and the second electrode 27, a portion, of the light emitting layer 25 that overlaps the insulation layer 23 does not emit light. That is, as shown in FIG. 3, portions of the lamination of the first electrodes 21, the light emitting layer 25 and the second electrode 27, which are located inside the ports 231, serve as the light emitting elements E (light sources). Thus, the position and form (size and shape) of each light emitting element E as viewed in the Z direction is determined by means of the position and form of the corresponding port 231.

Figure 4:
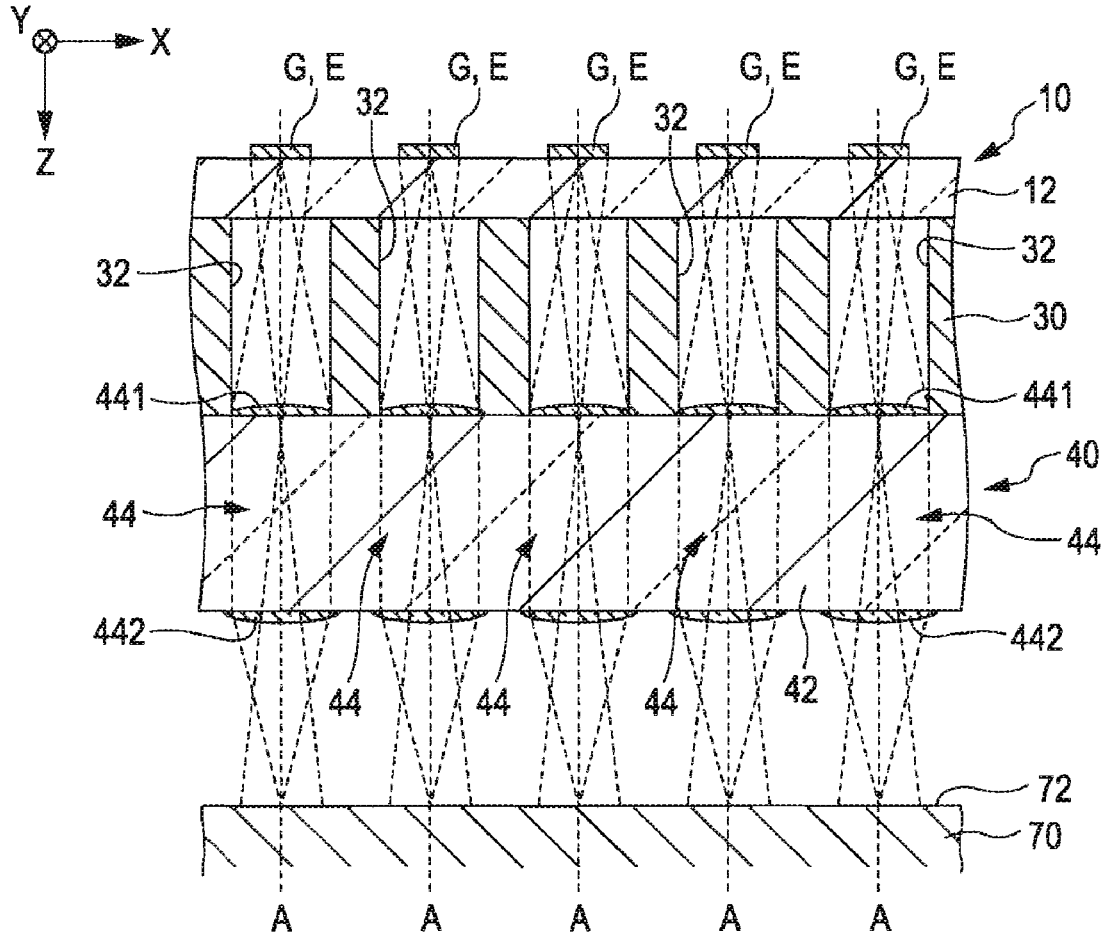
FIG. 4 is a cross-sectional view of a configuration of the exposure device.

The lens array 40 shown in FIG. 2 is a device that collects light emitted from the light emitting elements E toward the exposed surface 72. The lens array 40 includes a plurality of lenses 44 (biconvex lenses) that are arranged in an array along an X-Y plane. FIG. 4 is a cross-sectional view taken along the line IV-IV in FIG. 1 (cross-sectional view taken along an X-Z plane) As shown in FIG. 4, the lens array 40 includes a plate-like substrate 42, a plurality of lens portions 441, and a plurality of lens portions 442. The substrate 42 is formed of optically transparent material (for example, glass). The plurality of lens portions 441 are arranged on a surface of the substrate 42, which is opposite from the photoreceptor drum 70. The plurality of lens portions 442 are arranged on a surface of the substrate 42 opposite the photoreceptor drum 70. Each of the plurality of lens portions 441 is opposed to a corresponding one of the lens portions 442 with the substrate 42 interposed therebetween. Each of the lens portions 441 and each of the lens portions 442 are formed in a substantially circular shape using an optically transparent material that has a refractive index equal to that of the substrate 42. One lens 44 (microlens) is formed of the lens portion 441 and the lens portion 442 which overlap each other in the Z direction, and the substrate 42 filled between the lens portion 441 and the lens portion 442. The straight line that connects the center of each lens portion 441 with the center of the corresponding one of the lens portion 442 is an optical axis A of each lens 44.

Figure 5:
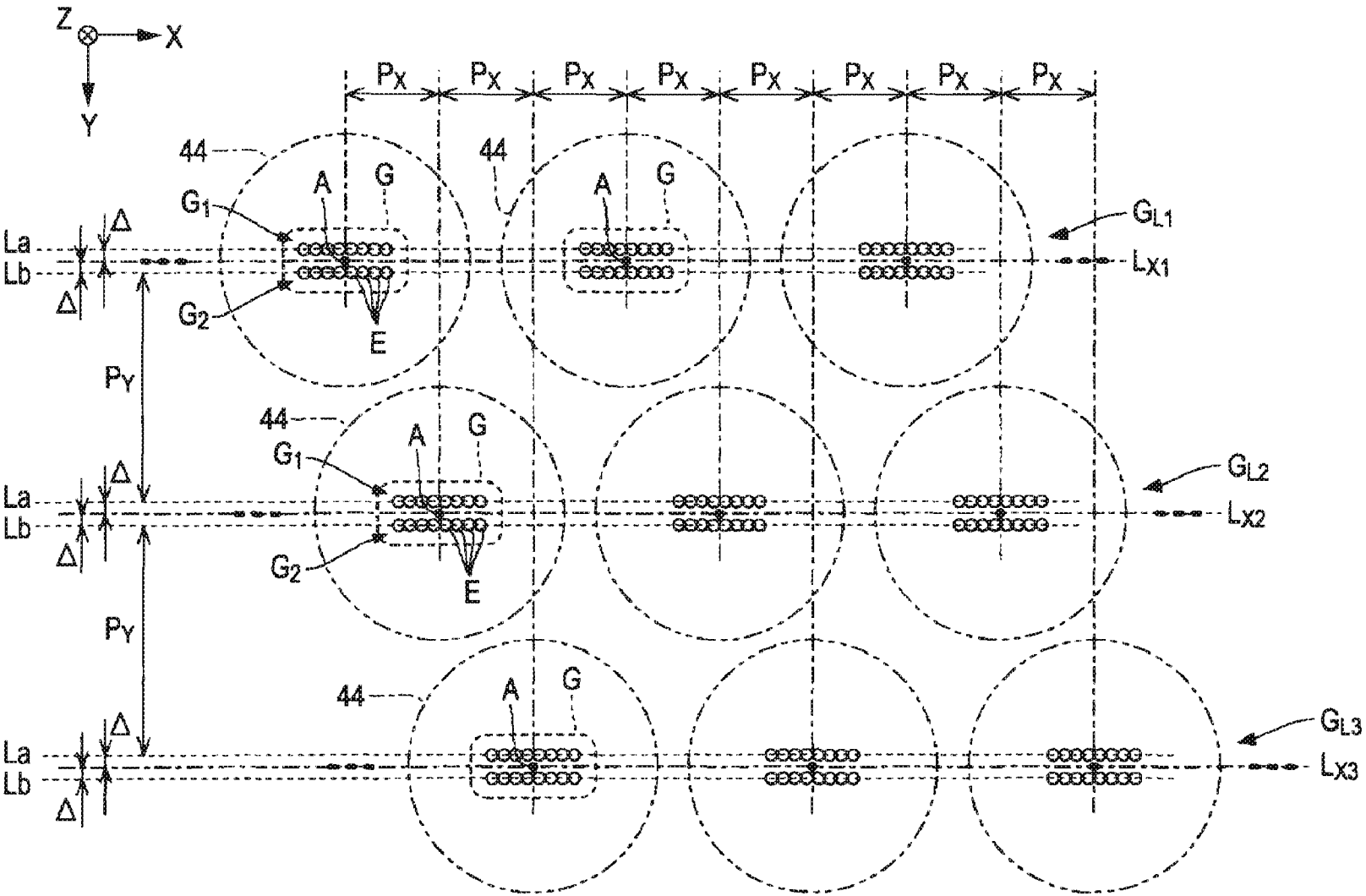
FIG. 5 is a plan view showing a relationship between lenses and corresponding element groups.

FIG. 5 is a plan view showing a relationship between the lenses 44 of the lens array 40 and the light emitting elements E of the light emitting device 10. In the drawing, the outlines of the lenses 44 (peripheries of the lens portions 441 and the lens portions 442), as viewed in the Z direction, are shown by alternate long and two short dashes line. As shown in FIG. 5, the plurality of lenses 44 that form the lens array 40 are separated into lens groups GL1 to GL3. The plurality of lenses 44 that belong to a lens group GLj (j is an integer that satisfies $1 \leqq j \leqq 3$) are arranged in the X direction so that each optical axis A intersects with a straight line LXj extending in the X direction. Straight lines LX1 to LX3 are arranged parallel to the Y direction at intervals (PY+2Δ) from one another.

The positions of the lenses 44 in the X direction vary among the lens groups GL1 to GL3. That is, the optical axis A of each of the lenses 44 of the lens group GL2 is arranged at a position to the positive side in the X direction by a distance PX from the optical axis A of the corresponding one of the lenses 44 of the lens group GL1, and the optical axis A of each of the lenses 44 of the lens group GL3 is arranged at a position to the positive side in the X direction by a distance PX from the optical axis A of the corresponding one of the lenses 44 of the lens group GL2. That is, the lenses 44 of the lens groups GL1 to GL3 are arranged by a pitch PX.

As shown in FIG. 5, the plurality of light emitting elements E of the light emitting device 10 are separated into a plurality of element groups G in units of a predetermined number of elements (sixteen in this embodiment). Each of the plurality of element groups G separately corresponds to a corresponding one of the lenses 44. As shown in FIG. 5, the light emitting elements E that belong to one element group G overlap the lens 44 corresponding to the element group C in the Z direction.

Each one of the element groups G is separated into a first element column G1 and a second element column G2. The first element column G1 of each element group G opposite the corresponding one of the lenses 44 of the lens group GLj consists of eight light emitting elements E that are arranged in the X direction along a straight line La, which is located a distance Δ away from a straight line LXj to the negative side in the Y direction, the straight line LXj passing through the optical axis A of the lens 44. Similarly, the second element column G2 of each element group G opposite the corresponding one of the lenses 44 of the lens group GLj consists of eight light emitting elements E that are arranged in the X direction along a straight line Lb that is located a distance Δ away from the straight line LXj to the positive side in the Y direction. As shown in FIG. 5, the light emitting elements E of each second element column G2 are located to the positive side in the Y direction with respect to the light emitting elements E of the corresponding first element column G1.

As shown in FIG. 4, the light blocking member 30 is a light blocking plate member that is fixed so that it is closely adhered to the substrate 12 and the substrate 42 in a gap between the light emitting device 10 and the lens array 40. As shown in FIG. 2 and FIG. 4, through-holes 32 are formed to extend through the light blocking member 30 in the thickness direction (Z direction) in regions of the light blocking member 30 which overlap the corresponding lenses 44 of the lens array 40 as viewed in the Z direction. Each of the through-holes 32 has the substantially same diameter as that of the lens portion 441.

As indicated by broken line in FIG. 4, light emitted from the light emitting elements E of one of the element groups G is transmitted through the substrate 12, and then advances inside the through-hole 32 and thereafter enters the lens 44 (lens portion 441) corresponding to the element group G. The light is then transmitted through the substrate 42 and exits from the lens 44 (lens portion 442). After that, the light is collected by means of the lens 44 while advancing, and finally forms an image on the exposed surface 72 of the photoreceptor drum 70.

A driving circuit (not shown of the light emitting device 10 controls timings when the light emitting elements E emit light so that a latent image corresponding to one line of an image is formed on the exposed surface 72 using light emitted from the light emitting elements E of the element groups G that are formed along the straight lines LX1 to LX3 (that is, all the light emitting elements E of the light emitting device 10). Schematically, a latent image of one line is formed when the light emitting elements E formed along the straight line LX1 (that is, the light emitting elements E opposite the lens group GL1) the light emitting elements E formed along the straight line LX2 and the light emitting elements E formed along the straight line LX3 sequentially emit light in the stated order, and the same operation is repeated in parallel with rotation of the photoreceptor drum 70, so that a latent image that consists of a plurality of lines is formed on the exposed surface 72. The timings when the light emitting elements E emit light when forming one line will be described in detail below.

Firstly, the light emitting elements E of the first element column G1 that belongs to one of the element groups G and the light emitting elements E of the second element column G2 that belongs to the same element group G sequentially emit light at a time interval during which the exposed surface 72 advances in the Y direction by the distance 2Δ shown in FIG. 5 (that is, the distance between the first element column G1 and the corresponding second element column G2). Thus, light emitted from the light emitting elements E that belong to the first element column G1 of one of the element groups G and light emitted from the light emitting elements E that belong to the second element column G2 of the same element group G are multiply irradiated to (multiply exposed to) a region of the exposed surface 72 where one line of the latent image will be formed.

Figure 6:
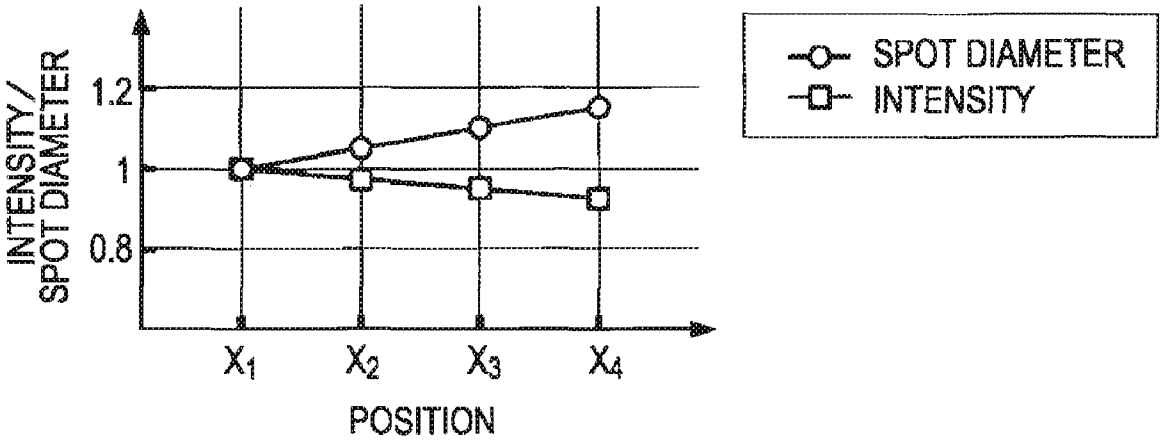
FIG. 6 is a graph that schematically shows a relationship between the diameter of a spot region and the position of a light emitting element and a relationship between the intensity of energy applied to the spot region and the position of a light emitting element according to a comparative example.

Secondly, the light emitting elements E that belong to the second element columns G2 of the element groups G formed on the straight line LX1 and the light emitting elements E that belong to the first element columns G1 of the element groups G formed on the straight line LX2 sequentially emit light at a time interval during which the exposed surface 72 advances in the Y direction by distance PY shorn in FIG. 5. Similarly, the light emitting elements E that belong to the second element columns G2 of the element groups G formed on the straight line LX2 and the light emitting elements E that belong to the first element columns G1 of the element groups G formed on the straight line LX3 sequentially emit light at a time interval during which the exposed surface 72 advances in the Y direction by distance PY. Thus, light emitted from the light emitting elements E of the element groups G formed along the corresponding straight lines LX1 to LX3 reaches the corresponding spot regions of the exposed surface 72 and the spot regions are arranged in lines along the X direction. Note that the above described procedure is intended to be illustrative, and the sequence and/or timings used to allow the light emitting elements E to emit light may be changed where appropriate However, since the light emitting elements E of one of the element groups G are arranged in the X direction, a distance from the optical axis A of the corresponding lens 44 varies among the light emitting elements E. On the other hand, the optical characteristics (for example, light collecting characteristics) of the lens 44 vary mainly on a distance from the optical axis A. Thus, in the configuration (hereinafter, referred to as "comparative example") in which the light emitting elements E of one element group G are arranged at regular intervals in the same form (size and shape), the size of the spot region of the exposed surface 72 irradiated by one light emitting element E and the intensity of energy applied to the spot region vary among the light emitting elements E on a distance from the optical axis A of the corresponding lens FIG. 6 is a graph that schematically shows a relationship between the size (diameter) of a spot region and the position of the light emitting element E and a relationship between the intensity of energy applied to the spot region and the position of the light emitting element E according to a configuration of the comparative example. The abscissa axis of the drawing indicates a position of the light emitting element E. A position X1 is the closest to the optical axis A of the lens 44. A position is farther from the optical axis A of the lens 44 the closer the position is to a position X4. In addition, the diameter (spot diameter) of a spot region and the intensity of energy applied indicated by the ordinate axis shown in the drawing are normalized so that the diameter of a spot region and the intensity of energy corresponding to the light emitting element E located at the position X1 become "1".

Since the light collecting performance of the lens 44 decreases the farther the position is from the optical axis A, in the configuration of the comparative example, as shown in FIG. 6, the diameter of the spot region is increased and the intensity of energy applied to the spot region is decreased the farther the light emitting element E that forms the spot region is located from the optical axis A of the lens 44. When there is variation in sizes of spot regions and/or intensities of energy applied to the spot regions as described above, there will be a possibility that a periodical non-uniformity occurs on an element group G to element group G basis in resolution and/or gray-scale level of a latent image formed on the exposed surface 72 (in addition, a developed image formed on a sheet of papery To address the above problem, in the present embodiment, the position and form of the light emitting element E are separately selected on the basis of a distance from the optical axis A of the corresponding lens 44 so that the size of the spot region and the intensity of energy applied are uniformized in the exposed surface 72.

Figure 7:
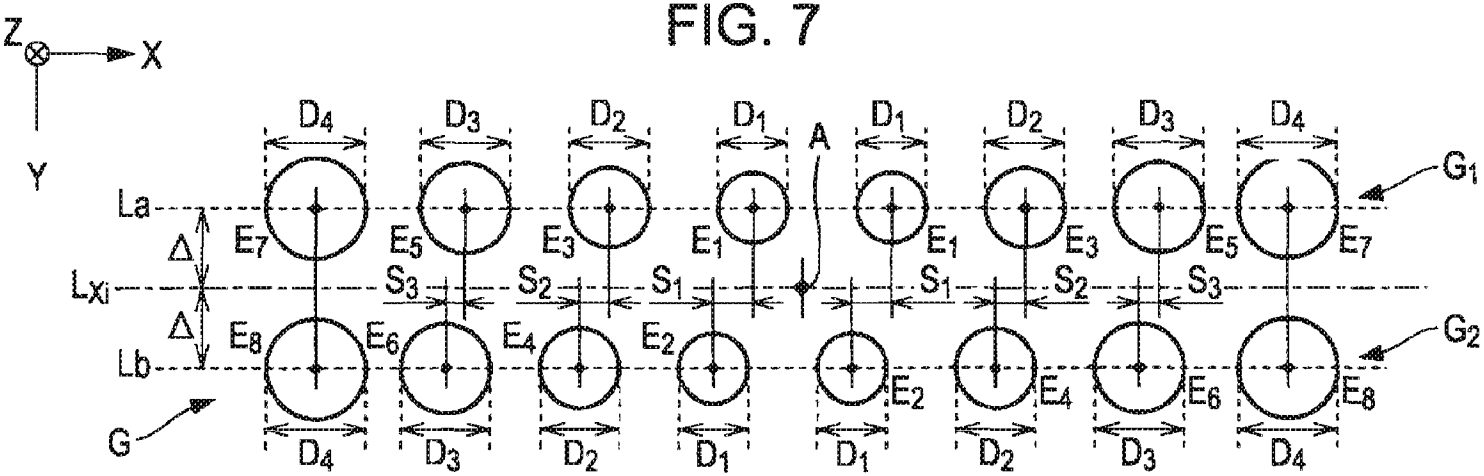
FIG. 7 is a plan view of a configuration of each of the light emitting elements that form one of the element groups.

FIG. 7 is a plan view of a specific configuration of each of the light emitting elements E (E1 to E8) that belong to one of the element groups G. As shown in the drawings the eight light emitting elements E of the first element column G1 are arranged in the X direction so that the centers of elements E are positioned in the straight line La, and the eight light emitting elements E of the second element column G2 are arranged in the X direction so that the centers of the elements E are positioned In the straight line Lb that is located a distance 2A away from the straight line La. By multiply exposing light emitted from one of the light emitting elements E of the first element column G1 and light emitted from one of the light emitting elements E of the second element column G2 that is arranged adjacently to the positive side in the Y direction, one spot region is formed on the exposed surface 72.

As shown in FIG. 7, distances in the X direction between the centers of the light emitting elements E that belong to the first element column G1 and the centers of the light emitting elements E of the second element column G2 that is located to the Y direction of that light emitting elements E increase the closer the light emitting element E is located to the optical axis A of the corresponding lens 44 (S1>S2>S3). More specifically, the distances S1 in the X direction between the centers of the light emitting elements E1 that are located the closest to the optical axis A among the first element column G1 and the centers of the light emitting elements E2 adjacent to the light emitting elements E1 along the Y direction among the second element column G2 are larger than the distances S2 in the X direction between the centers of the light emitting elements E3 that are located away from the optical axis A than the light emitting elements E1 among the first element column G1 and the centers of the light emitting elements E4 adjacent to the light emitting elements E3 along the Y direction among the second element column G2 Similarly, the distances S2 between the centers of the light emitting elements E3 and the centers of the light emitting elements E4 are larger than the distances S3 between the centers of the light emitting elements E5 and the centers of the light emitting elements E6, which are located further away from the optical axis A. In addition, the centers of the light emitting elements E7 that are located the farthest from the optical axis A among the first element column G1 are located at the same positions in the X direction as the centers of the light emitting elements E8 adjacent to the light emitting elements E7 along the Y direction among the second element column G2 (the distances between the centers along the X direction are zero)

Furthermore, as shown in FIG. 7, the sizes of the light emitting elements E (diameters D1, D2, D3, D4) increase the farther the light emitting element E is located away from the optical axis A of the corresponding lens 44 (D4>D3>D2>D1). For example, the diameters D2 of the light emitting elements E3, E4 are larger than the diameters D1 of the light emitting elements E1, E2 that are located closer to the optical axis A, and the diameters D3 of the light emitting elements E5, E6 are larger than the diameters D2. In addition, the diameters D4 of the light emitting elements E7, E8 that are located the farthest away from the optical axis A are the maximum among the elements E of the element group G. The positions (distances S1, S2, S3) and sizes (diameters D1, D2, D3, D4) of the light emitting elements E are regulated by means of the positions and sizes of the ports 231 formed in the insulation layer 23 shown in FIG. 3 so as to satisfy the above described conditions.

Figure 8:
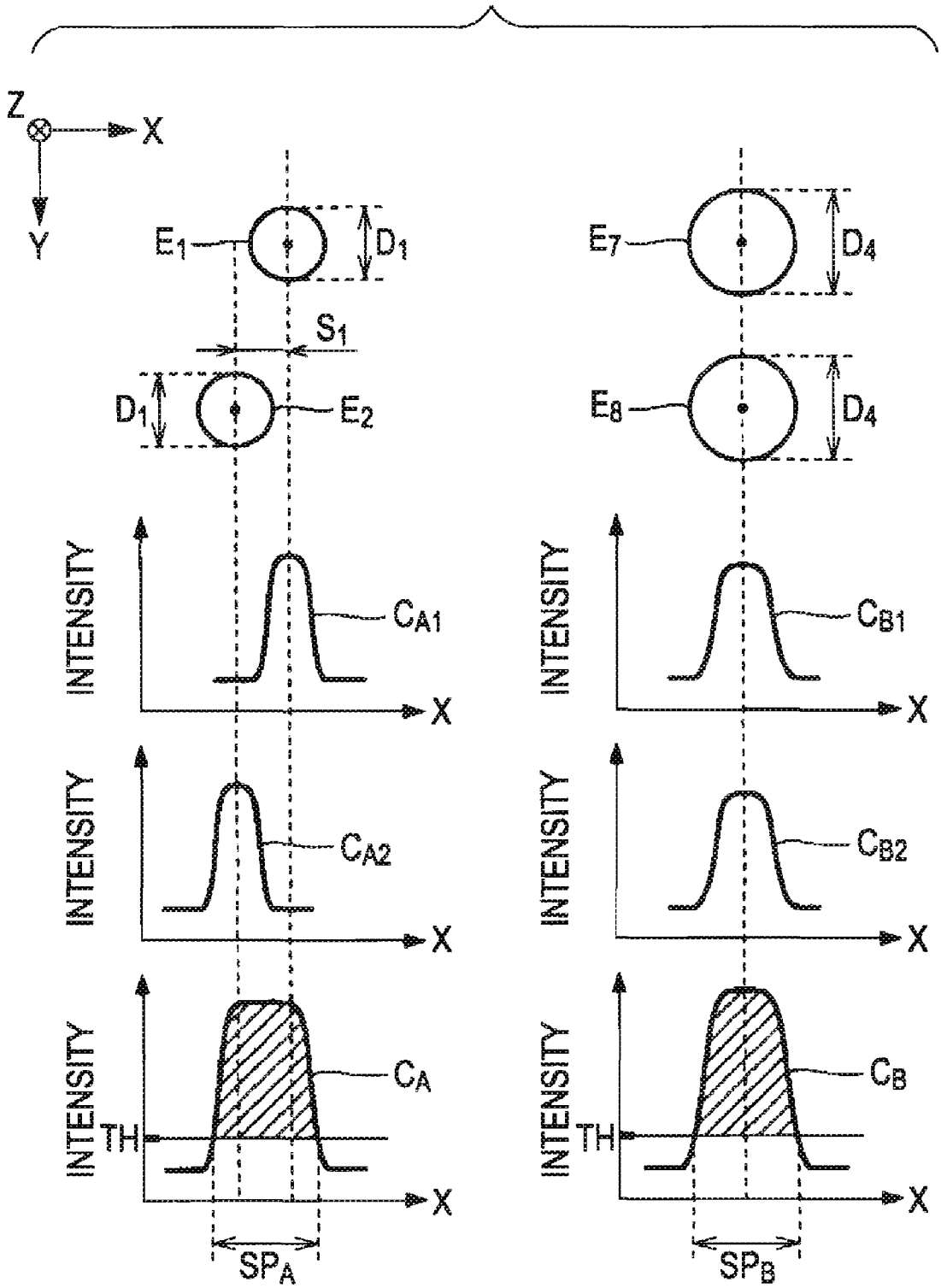
FIG. 8 is a conceptional view showing a distribution of intensity of energy that each of the light emitting elements applies to an exposed surface.

FIG. 8 is a conceptional view showing a distribution of the intensity of energy applied to the exposed surface 72 by irradiating light emitted from the light emitting elements E. The curve CA1 shown in the drawing indicates a distribution of intensity of energy that each of the light emitting elements E1 applies. The curve CA2 shown in the drawing indicates a distribution of intensity of energy that each of the light emitting element E2 applies. The curve CA indicates a distribution of intensity of energy applied to the exposed surface 72 on the basis of multiple rays of light emitted from each of the light emitting elements E1 and each of the light emitting elements E2 (adding the curve CA1 and the curve CA2). Similarly, the curve CB indicates a value obtained by adding a distribution of intensity of energy that each of the light emitting elements E7 applies (curve CB1) and a distribution of intensity of energy that each of the light emitting element E8 applies (curve CB2) (that is, a distribution of intensity of energy applied to the exposed surface 72 through multiple rays of light emitted from each of the light emitting elements E7 and each of the light emitting elements E8).

As shown in FIG. 8, spot regions SP (SPA, SPB) are regions in which the intensity of energy applied exceeds a predetermined threshold value TH (for example, 5% of peak value). Since each of the light emitting elements E1 is located offset from the corresponding one of the light emitting elements E2 in the X direction, the size of the spot region SPA formed by multiply exposing light with the light emitting elements E1, E2 is substantively enlarged in comparison with the case where each of the emitting elements E1 is located at the same position in the X direction as the corresponding one of the light emitting elements E2. That is, as shown in FIG. 8, it is possible to approximate the size of the spot region SPA formed by multiply exposing light with the light emitting elements E1, E2 to the size of the spot region SPB formed by multiply exposing light with the light emitting elements E7, E8.

Figure 9:
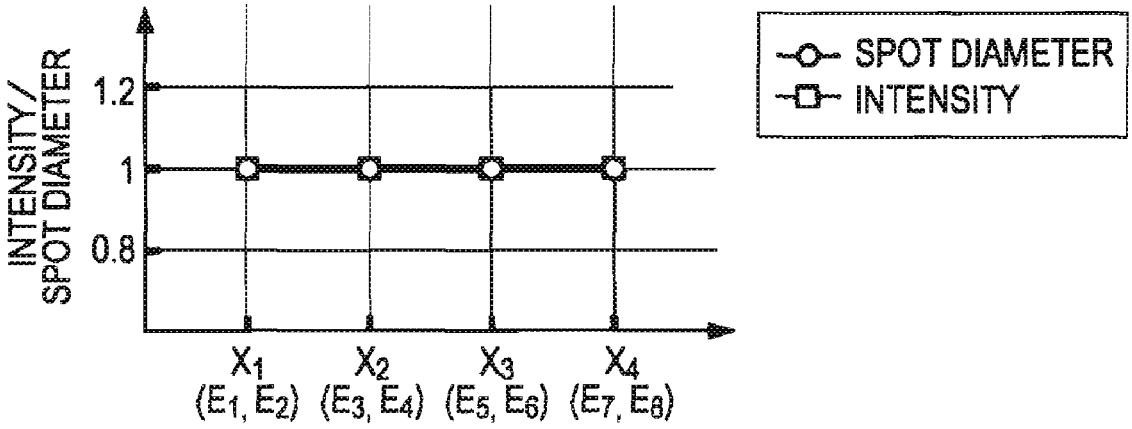
FIG. 9 is a graph that schematically shows a relationship between the diameter of a spot region and the position of a light emitting element and a relationship between the intensity of energy applied to the spot region and the position of a light emitting element.

FIG. 9 is a graph that schematically shows the size of a spot region and the intensity of energy applied to the spot region for every light emitting element E according to the present embodiment. The diameter (spot diameter) of a spot region and the intensity of energy applied indicated by the ordinate axis shown in the drawing are normalized so that the diameter and intensity of energy of the spot region SPA, which is formed with the light emitting elements E1, E2, become "1" as in the case of those of FIG. 6. As shown in FIG. 9, in the present embodiment, the distances (S1, S2, S3) between the centers of the adjacent light emitting elements E in the Y direction are selected on the basis of the distances from the optical axis A so that the sizes (the lengths in the X direction) of the spot regions formed by multiply exposing light with the two adjacent light emitting elements E in the Y direction are uniformized.

In addition, as shown in FIG. 7, since the light emitting elements E7, E8 are formed to have larger diameters than those of the light emitting elements E1, E2, the intensity of energy applied to the spot region formed by multiply exposing light with the light emitting elements E7, E8 increases in comparison with the case where all the light emitting elements E of the element group G are formed to have the same diameters. That is, a decrease in intensity of energy due to a distance from the optical axis A of the lens 44 is compensated by enlargement of size of the light emitting element E. Thus, as shown in FIG. 8, it is possible to approximate the sum of intensities of energy applied to the spot region SPB by multiply exposing light with the light emitting elements E7, E8 (the area indicated by the diagonal lines in FIG. 8) to the scorn of intensities of energy applied to the spot region SPA by multiply exposing light with the light emitting elements E1, E2. In the present embodiment, as shown in FIG. 9, the sizes of the light emitting elements E are selected on the basis of the distances from the optical axis A so that the intensities of energy applied to the plurality of spot regions formed by multiply exposing light with the light emitting elements E of one element groups G are uniformized.

As described above, in the present embodiment, since the sizes and intensities of energy of the spot regions are uniformized by separately selecting the positions and forms of the light emitting elements E that belong to one element group G on the basis of the distances from the optical axis A of the lens 44, it is possible to suppress non-uniformity in resolution and gray-scale level of an image (developed image) formed by the image forming apparatus. In addition, it is advantageous in that the advantageous effects as described above are obtained by means of a simple method that the position and form of each of the ports 231 formed in the insulation layer 23 is controlled.

Note that, because the advantageous effect that the sizes (diameters) of the spot regions are uniformized is obtained by increasing the distances (S1, 32, S3) between the centers the closer the light emitting element E is located to the optical axis A of the lens 44, it is not necessarily increase the size of the light emitting element E the farther the light emitting element E is located from the optical axis A of the lens 44. However, when all the light emitting elements E that belong to one element group G have the same diameter, as shown in FIG. 6, there is a problem that the intensity of energy applied to the spot region decreases the farther the light emitting element E is located from the optical axis A. Of course, it is possible to uniformize the intensities of energy applied to the spot regions when an electric current supplied to the light emitting element E is increased the farther the light emitting element E is located from the optical axis A. However, particularly, the light emitting element E, such as an organic light emitting diode element, may progressively degrade the larger a current density of an electric current is supplied thereto. Therefore, characteristics of the light emitting element E may early degrade the farther the light emitting element E is located from the optical axis A. As a result, there may be a problem that variation in characteristics of the light emitting elements E (further, chrominance non-uniformity in gray-scale levels of an image) increases with time.

In contrast, in the present embodiment, because the intensities of energy applied to the spot regions are uniformized by increasing the size of the light emitting element E the farther the light emitting element E is located from the optical axis A, it is possible to effectively reduce the above problem that variation in characteristics of the light emitting elements E increases with time. Note that the present embodiment may eliminate the problem of configuration that the intensities of energy applied to the spot regions are uniformized by adjusting values of electric currents; however, it is not intended to exclude, from the scope of the present invention, the configuration that the values of electric current supplied to the light emitting elements E are controlled. For example, as exemplified in FIG. 7, needless to say, it may be employed that the values of electric current supplied to the light emitting elements E are adjusted so that the sizes of the light emitting elements E are adjusted and the intensities of energy applied to the soot regions are then reliably uniformized.

B: Second Embodiment

A second embodiment according to the invention will now be described. Note that the same reference numerals are assigned to the components of the present embodiment having the same or similar operation and function as those of the first embodiment, and a detailed description thereof is omitted where appropriate.

Figure 10:
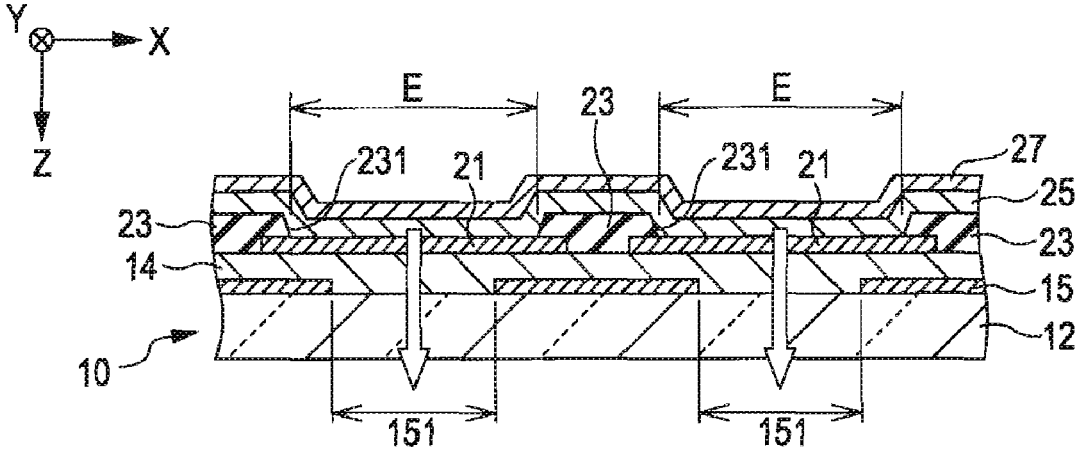
FIG. 10 is a cross-sectional view of a configuration of a light emitting device according to a second embodiment of the invention.

FIG. 10 is a cross-sectional view (cross-sectional view corresponding to FIG. 3) of a configuration of a light emitting device 10 according to a second embodiment of the invention. As shown in FIG. 10, the wiring element layer 14 of the light emitting device 10 according to the present embodiment includes a light blocking layer 15. The light blocking layer 15 is a light blocking film that is formed integrally with the layer that includes wirings that transmit various signals and active elements that control the amount of light emitted from the light emitting elements E. The light blocking layer 15 includes substantially circular ports 151 formed in a region that overlaps the light emitting elements E as viewed in the Z direction. Of the light emitted from the light emitting elements E, only the component of light that has passed through the ports 151 of the light blocking layer 15 is transmitted through the substrate 12 and then exits toward the photoreceptor drum 70. The first embodiment exemplifies the configuration that the sizes and intensities of energy of the spot regions are controlled by means of the positions and forms of the ports 231 of the insulation layer 23. In contrast, in the present embodiment, the sizes and intensities of energy of the spot regions are controlled by means of the positions and forms of the ports 151 of the light blocking layer 15.

Figure 11:
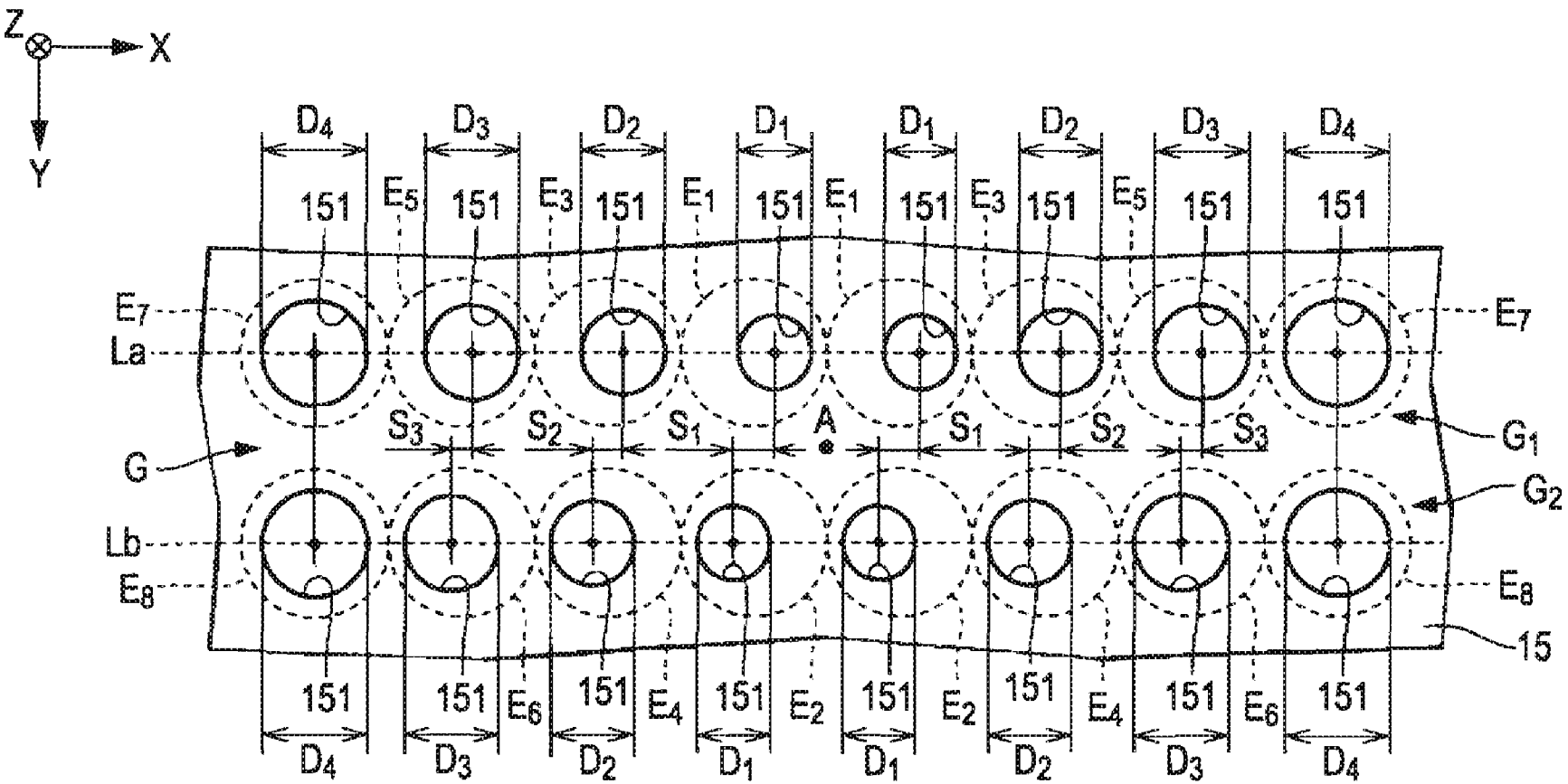
FIG. 11 is a plan view showing a relationship between ports of a light blocking layer and the light emitting elements.

FIG. 11 is a plan view (plan view corresponding to FIG. 7) showing specific forms of the light emitting elements E that belong to one element group G. As shown in FIG. 11, in the present embodiment, all the light emitting elements E (E1 to E8) are formed to have the same diameters. In addition, the eight light emitting elements E of the first element column G1 are arranged at regular intervals along the X direction, and the eight light emitting elements E of the second element column G2 are arranged at regular intervals along the X direction at positions located a distance away from the first element column G1 in the Y direction.

As shown in FIG. 11, distances (S1, S2, S3) along the X direction between the centers of the ports 151 corresponding to the light emitting elements E of the first element column G1 and the centers of the ports 151 corresponding to the light emitting elements E of the second element column G2 located adjacent to that light emitting elements E of the first element column G1 in the Y direction increase the closer PC ports 151 are located to the optical axis A of the lens 44 (S1>S2>S3) In addition, the positions of the centers of the ports 151 corresponding to the light emitting elements E7 agree with the positions of the centers of the corresponding ports 151 corresponding to the light emitting elements E8. Furthermore, as shown in FIG. 11, the diameters of the ports 151 are increased the farther the corresponding light emitting elements E are located from the optical axis A of the lens 44 (D4>D3>D2>D1).

In the present embodiment as well, a distribution of intensities of energy on the exposed surface 72 is the same as that of FIG. 8, so that the same functions and advantageous effects are obtained as those of the first embodiment. As described above, in the first embodiment, the light emitting elements E serve as light sources, while, on the other hand, in the present embodiment, the light emitting elements E and the light blocking layer 15 (ports 151) cooperate to serve as light sources.

C: Alternative Embodiments

The above described embodiments may be modified into the following alternative embodiments Specific alternative embodiments may be exemplified as follows. Note that the following embodiments may be combined with each other where appropriate.

(1) First Alternative Embodiment

Figure 12:
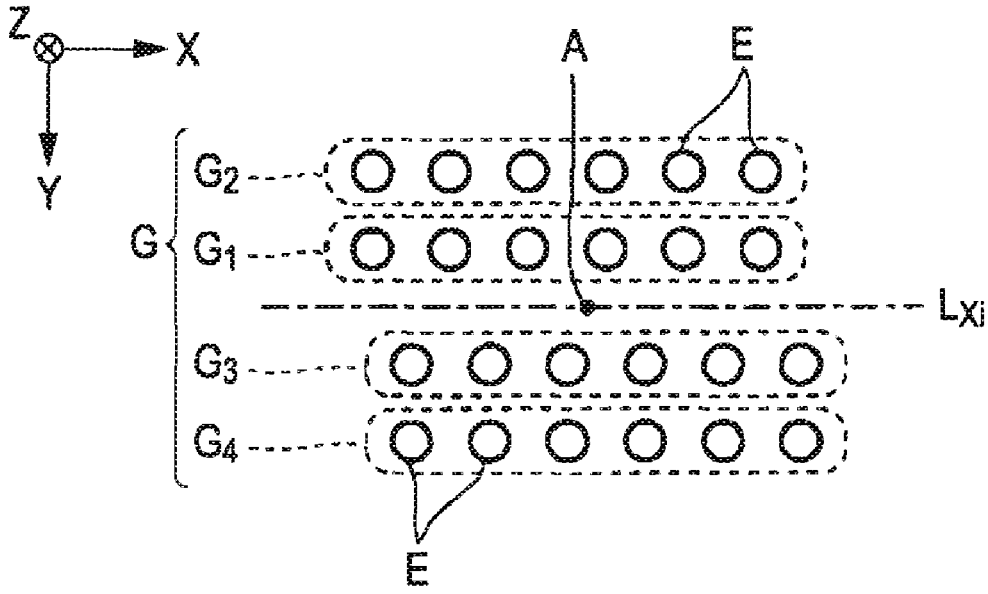
FIG. 12 is a plan view of a configuration of element groups according to an alternative embodiment.

The above described embodiments exemplify the configuration that one of the element groups G consists of the first element column G1 and the second element column G2. However, the number of light emitting elements E arranged in one element group G is arbitrarily determined. For example, as shown in FIG. 12, a plurality of light emitting elements E that belong to one element group G may employ a configuration in which four columns consisting of a first element column G1, a second element column G2, a third element column G3 and a fourth element column G4 are arranged. Each of the light emitting elements E that belong to the first element column G1 and the second element column G2 is different in position in the X direction from the corresponding one of the light emitting elements E that belong to the third element column G3 and the fourth element column G4. Thus, for example; pixels in one of the odd-numbered lines of a latent image are formed by multiply exposing light with the light emitting elements E of the first element column G1 and the second element column G2, and pixels in one of the even-numbered lines of the latent image are formed by multiply exposing light with the light emitting elements E of the third element column G3 and the fourth element column G4. In the configuration shown in. FIG. 12, the positions and forms of the light emitting elements E are selected so that the relationship between the light emitting elements E of the first element column G1 and the light emitting elements E of the second element column G2 and the relationship between the light emitting elements E of the third element column G3 and the light emitting elements E of the fourth element column G4 satisfy the conditions shown in FIG. 7 or FIG. 11.

Figure 13:
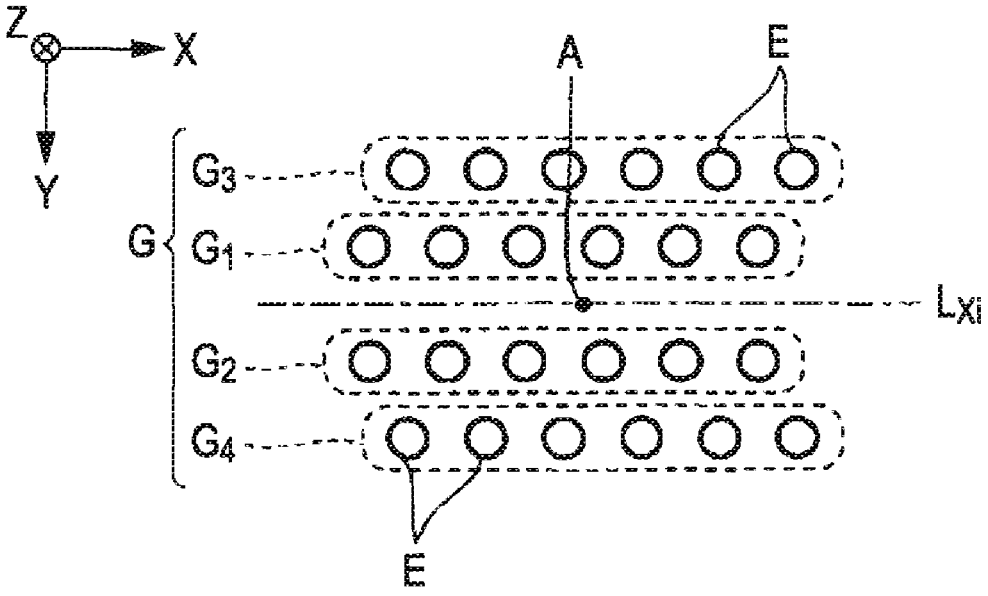
FIG. 13 is a plan view of a configuration of element groups according to an alternative embodiment.

In addition, a configuration as shown in FIG. 13 may be employed, in which a first element column G1 and a second element column G2 are arranged in the X direction at positions located the same distance from the optical axis A and, in addition, a third element column G3 and a fourth element column G4 are located outside the first element column G1 and the second element column G2, respectively, and arranged at positions located the same distance from the optical axis A. In the configuration shown in FIG. 12, because the distances at which the light emitting elements E of the first element column G1 are located from the optical axis A are different from those of the corresponding light emitting elements E of the second element column G2, it is necessary to differentiate the sizes of two adjacent light emitting elements E in the Y direction (that are used for multiply exposing light to one spot region) among the element columns. The same applies to the third element column G3 and the fourth element column G4. In contrast, in the configuration shown in FIG. 13, the first element column G1 and the second element column G2 (or the third element column G3 and the fourth element column G4) are located substantially the same distance from the optical axis A, similarly as in the case of FIG. 7 or FIG. 11, it is possible to use the common sizes of two light emitting elements E used for multiply exposing light to one spot region. Thus, it is advantageous in that the configuration of the light emitting device 10 is simple.

(2) Second Alternative Embodiment

In the above described embodiments, the ports 231 of the insulation layer 23 or the, ports 151 of the light blocking layer 15 are adjusted. However, an element for controlling the position and form of a light source (a region through which light emitted from the light emitting layer 25 actually exits) is not limited to the above described embodiments. For example, the positions and forms of light sources may be selected by means of the positions and shapes of the first electrodes 21 so as to satisfy the conditions shown in FIG. 7 or FIG. 11. In addition, the bottom-emission-type light emitting device 10 is exemplified in FIG. 3 and FIG. 10. However, a top-emission-type light emitting device may be employed.

(3) Third Alternative Embodiment

The organic light emitting diode element is only an example of a light emitting element. For example, various light emitting elements, such as an inorganic EL element or an LED (light emitting diode) element, may be employed in place of the organic light emitting diode in the above described embodiments.

D: Application Examples

Figure 14:
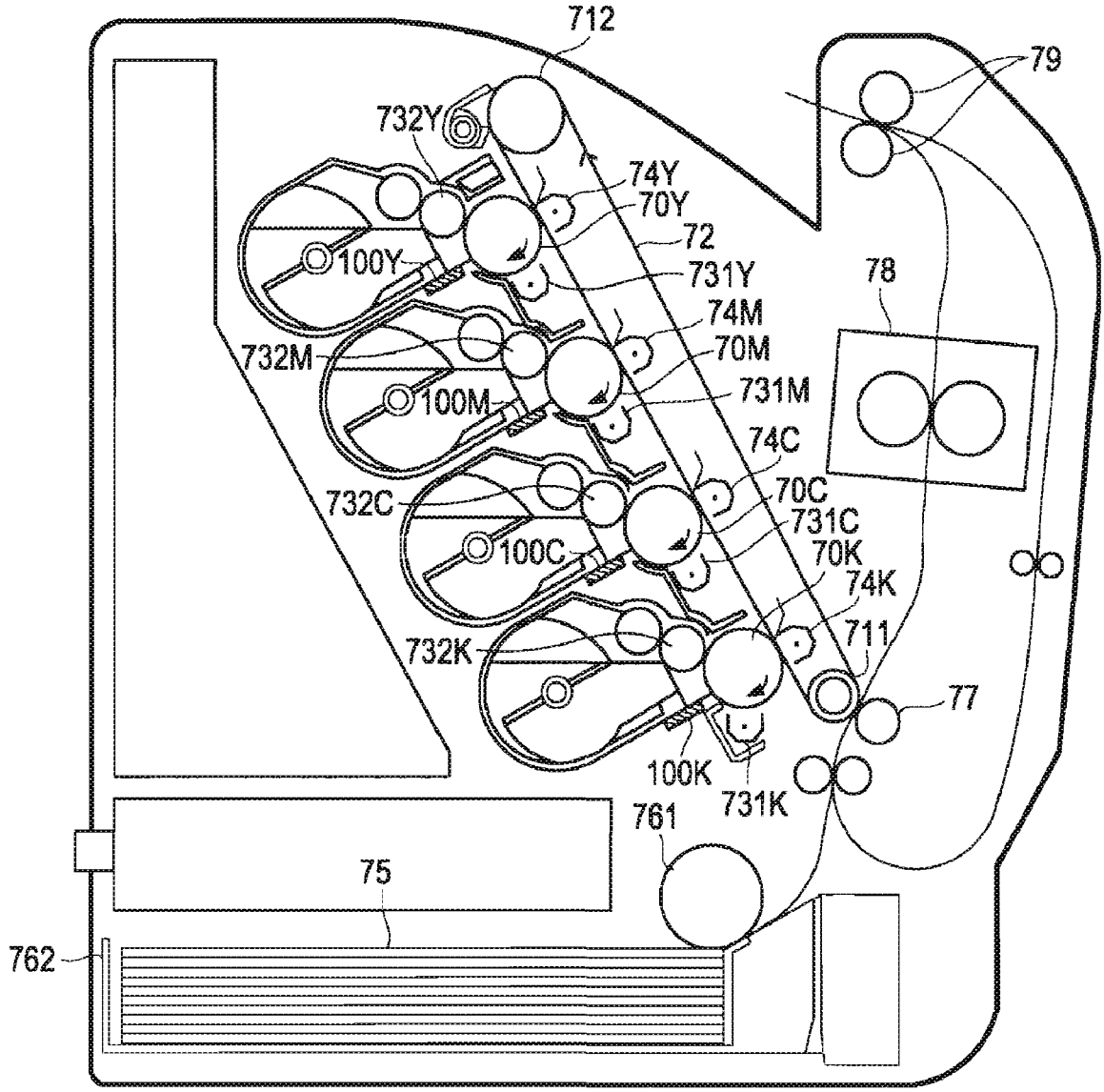
FIG. 14 is a cross-sectional view of an electronic apparatus (image forming apparatus) according to an embodiment of the invention.

A specific embodiment of an electronic apparatus (image forming apparatus) that uses the exposure device 100 according to the aspects of the invention will be described. FIG. 14 is a cross-sectional view of a configuration of an image forming apparatus that employs the exposure device 100 according to the above described embodiments. The image forming apparatus is a tandem full color image forming apparatus and includes four of the exposure devices 100 (100K, 100C, 100M, 100Y) according to the above described embodiments and four of the photoreceptor drums 70 (70K, 70C, 70M, 70Y) corresponding to the exposure devices 100. As shown in FIG. 1, one of the exposure devices 100 is opposed to the exposed surface 72. (outer peripheral surface) of the photoreceptor dram 70 corresponding to that exposure device 100. Note that the suffixes of the reference numerals "K", "C", "M", "Y" mean that they are used for forming developed images of black (K), cyan (C), magenta (M), yellow (Y).

As shown in FIG. 14, an endless intermediate transfer belt 72 is wound around a drive roller 711 and a driven roller 712. The four photoreceptor drums 70 are arranged around the intermediate transfer belt 72 at predetermined intervals from each other. The photoreceptor drums 70 rotate in synchronization with driving of the intermediate transfer belt 72.

Corona chargers 731 (731K, 731C, 731M, 731Y) and developing devices 732 (732K, 732C, 732M, 732Y) are arranged around the photoreceptor drums 70 in addition to the exposure devices 100. Each of the corona chargers 731 electrostatically charges an image forming surface of the corresponding one of the photoreceptor drum 70 uniformly. Each of the charged image forming surface is exposed with the corresponding exposure device 100, so that an electrostatic latent image is formed. Each of the developing devices 732 forms a developed image (visible image) on the corresponding photoreceptor drum 70 by adhering a developing material (toner) to the electrostatic latent image.

As described above, developed images of colors (black, cyan, magenta, yellow) formed on the photoreceptor dram 70 are sequentially transferred (primarily transferred) onto the surface of the intermediate transfer belt 72, so that a full color developed image is formed. Four primary transfer corotrons (copiers) 74 (74K, 74C, 74M, 74Y) are arranged inside the intermediate transfer belt 72. Each of the primary transfer corotrons 74 electrostatically absorbs a developed image from the photoreceptor drum 70 corresponding thereto to copy the developed image onto the intermediate transfer belt 72 that passes a clearance between the photoreceptor drum 70 and the primary transfer corotron 74.

The sheets of paper (recording media) 75 are fed sheet by sheet from a paper cassette 762 by a pick up roller 761 and transported to a nip between the intermediate transfer belt 72 and a secondary transfer roller 77. The full color developed image formed on the surface of the intermediate transfer belt 72 is copied (secondary transferred) onto one surface of the sheet of paper 75 by the secondary transfer roller 77 and fixed on the sheet of paper 75r when passed through a pair of fixing rollers 78. A pair of paper discharge rollers 79 discharge the sheet of paper 75 on which a developed image is fixed through the above described processes.

Since the above exemplified image forming apparatus uses an organic light emitting diode element as a light source, the size of the apparatus may be reduced as compared to a configuration that uses an optical laser scanning system. Note that the exposure device 100 may be applied to image forming apparatuses other than the above exemplified configuration. For example, the exposure device 100 may be used for a rotary developing image forming apparatus, an image forming apparatus of a type that directly copies a developed Image from the photoreceptor drum 70 onto a sheet without any intermediate transfer belt, or an image forming apparatus that forms a monochrome image.

Note that applications of the exposure device 100 are not limited to exposure of image carrier. For example, the exposure device 100 may be installed in an image reading apparatus as a lighting device that irradiates light to a reading target, such as an original document. The image reading apparatus of this type includes a scanner, a reading portion of a copier or facsimile machine, a bar code reader, a two-dimensional code reader, such as a QR code (registered trademark), that reads a two-dimensional code.

The entire disclosure of Japanese Patent Application No. 2006-267583, filed Sep. 29, 2006 is expressly incorporated by reference herein.

What is claimed is:

1. An exposure device comprising:

at least one first light source column that includes a plurality of light sources that are arranged in a first direction;

at least one second light source column that includes a plurality of light sources that are arranged in the first direction and located a distance from the corresponding light sources of the first light source column in a second direction that intersects with the first direction; and at least one light converger that collects light emitted from each of the light sources of the first light source column and the second light source column toward an exposed surface, wherein light emitted from the light sources of the first light source column and light emitted from the corresponding light sources of the second light source column, which are located to the second direction relative to the light sources of the first light source column, are multiply exposed on the exposed surface, a distance along the first direction between the center of a first light source of the first light source column and the center of a second light source of the second light source column, which is located to the second direction relative to the first light source, is larger than a distance along the first direction between the center of a third light source of the first light source column, which is located farther from an optical axis of the light converger than the first light source and the center of a fourth light source of the second light source column, which is located to the second direction relative to the third light source.

2. The exposure device according to claim 1, wherein the light source of the first light source column, which is located the farthest from the optical axis of the light converger and the light source of the second light source column, which is located to the second direction relative to the corresponding light source of the first light source column, are located at the same position along the first directions.

3. The exposure device according to claim 1, wherein the sizes of the third light source and the fourth light source are larger than the sizes of the first light source and the second light source.

4. The exposure device according to claim 3, wherein the first light source column is formed at a position located a predetermined distance away from the optical axis of the light converger, and the second light source column is formed at a position located a predetermined distance away from the optical axis and on the opposite side relative to the first light source column with the optical axis located therebetween.

5. The exposure device according to claim 1, wherein each of the light sources includes a light emitting element having a light emitting layer positioned inside a port formed in an insulation layer, and, the position and form of each light source are determined by means of the position and form of the port of the insulation layer, the port corresponding to the light source.

6. The exposure device according to claim 1, wherein each of the light sources includes a light emitting element and a light blocking layer that includes a port that allows light emitted from the light emitting element toward the exposed surface to pass therethrough, and the position and form of each light source are determined by means of the position and form of the port of the light blocking layer, the port corresponding to the light source.

7. The exposure device according to claim 1, further comprising:

a plurality of element groups, each of which includes the first light source column and the second light source column; and a plurality of the light convergers that are provided in correspondence with the different element groups.

8. The exposure device according to claim 1, wherein the position and form of each light source is selected so that a spot region that is formed on the exposed surface by multiply exposing light emitted from the first light source and light emitted from the second light source has the same size and the same intensity of energy applied as a spot region that is formed on the exposed surface by multiply exposing light emitted from the third light source and light emitted from the fourth light source.

9. An image forming apparatus comprising:

the exposure device according to claim 1;

an image carrier that has an exposed surface, on which a latent image is formed by exposing light thereto by means of the exposure device, wherein the exposed surface advances in the second direction relative to the exposure device; and a developing device that forms a developed image by adding a developer to the latent image formed on the image carrier.

* * * * *